US008925522B2

(12) United States Patent
Landenberger et al.

(10) Patent No.: US 8,925,522 B2
(45) Date of Patent: Jan. 6, 2015

(54) FUEL METERING DEVICE FOR A FUEL INJECTION SYSTEM

(75) Inventors: Tobias Landenberger, Schorndorf (DE); Tilman Miehle, Waiblingen (DE); Jochen Wessner, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 333 days.

(21) Appl. No.: 13/390,240

(22) PCT Filed: Jun. 22, 2010

(86) PCT No.: PCT/EP2010/058791

§ 371 (c)(1),
(2), (4) Date: Mar. 6, 2012

(87) PCT Pub. No.: WO2011/018265

PCT Pub. Date: Feb. 17, 2011

(65) Prior Publication Data

US 2012/0152208 A1 Jun. 21, 2012

(30) Foreign Application Priority Data

Aug. 13, 2009 (DE) ..... 10 2009 028 501

(51) Int. Cl.
*F02M 59/36* (2006.01)
*F02M 59/44* (2006.01)

(52) U.S. Cl.
CPC ..... *F02M 59/36* (2013.01); *F02M 59/366* (2013.01); *F02M 59/445* (2013.01); *F02M 2200/9015* (2013.01)
USPC ..... 123/458; 123/510

(58) Field of Classification Search
CPC . F02M 59/366; F02M 63/023; F02D 2250/31
USPC ..... 123/510, 446, 458; 251/129.07
See application file for complete search history.

(56) References Cited

U.S. PATENT DOCUMENTS 5,467,749 A * 11/1995 Meiwes et al. ..... 123/339.27
6,446,606 B1 * 9/2002 Krimmer et al. ..... 123/458

FOREIGN PATENT DOCUMENTS

| | | | |
|---|---|---|---|
| CN | 1752430 | A | 3/2006 |
| DE | 10036939 | A1 | 2/2002 |
| DE | 102004057011 | A1 | 6/2005 |
| DE | 102007021593 | A1 | 11/2008 |
| DE | 10 2007 059 855 | A1 | 6/2009 |
| DE | 102007057503 | A1 | 6/2009 |
| DE | 102008018018 | A1 | 10/2009 |
| JP | 2002-530568 | A | 9/2002 |

* cited by examiner

*Primary Examiner* — Hai Huynh
(74) *Attorney, Agent, or Firm* — Maginot, Moore & Beck LLP

(57) ABSTRACT

The present invention relates to a fuel metering device for a fuel injection system for internal combustion engines having a plastic housing. According to the invention, the fuel metering device includes a control valve having a valve piston which is actuated by an actuating device. Furthermore, the plastic housing can be produced by spray-coating.

18 Claims, 3 Drawing Sheets

FUEL METERING DEVICE FOR A FUEL INJECTION SYSTEM

CROSS-REFERENCE TO RELATED APPLICATION

This application is a 35 USC 371 application of PCT/EP 2010/058791 filed on Jun. 22, 2010.

BACKGROUND OF THE INVENTION

1. Field of the Invention

The invention relates to a fuel metering device for a fuel injection system for internal combustion engines.

2. Description of the Prior Art

One such fuel metering device is known for instance from German patent disclosure DE 10 2005 025 872 A1. The fuel metering device serves to regulate delivery quantities on the intake side to a fuel pump, which is part of a fuel injection system of an internal combustion engine. The known fuel injection system has a control valve, actuated by an electromagnet, with a valve piston by which different flow cross sections can be established in the intake region of a high-pressure fuel pump. As a result, the delivery quantity of the fuel pump is controlled. The electromagnet has an armature and a movable armature bolt that actuates the valve piston. The armature bolt and the control valve are disposed coaxially in line with one another; the armature is disposed on an opposite end of the armature bolt from the control valve. The fuel metering device typically includes a magnet part, spray-coated with plastic, and a hydraulic control part, preferably formed by steel parts.

ADVANTAGES AND SUMMARY OF THE INVENTION

In the fuel metering device of the invention, it is proposed that the housing be produced from a plastic spray coating. This widens the housing for the hydraulic control circuit. The housing can thus take on an outward sealing function with regard to the fuel. As a result, for the same functionality, the fuel metering device can be made more compactly and at less cost. The technical properties, such as formability, hardness, elasticity, breaking strength, heat resistance, and resistance to fuel, can be adjusted within wide limits by means of the selection of starting materials, production processes, and admixtures of additives. Thus virtually any mechanical and/or thermal need can be met. Moreover, plastic has a low specific weight compared to metal and is comparatively inexpensive. Magnetic fluxes are unaffected by plastic.

Being embodied of plastic enables the economical production of standard metering units in large-scale mass production as well as the production of smaller-scale mass production, in which for example the bush for making electrical contact is designed differently from the large-scale production series, since these bushes can be joined to the plastic housing afterward, and at reasonable expense, by welding, Moreover, by construction with the proper material, the structural length of the fuel metering device can be reduced.

Characteristics that are important to the invention are also found in the ensuing description and in the drawings; the characteristics may be important to the invention either alone or in arbitrary combinations, even if there is no explicit reference to this.

Advantageously, it is provided that the housing has at least one opening for the introduction of components of the fuel metering device, and the openings can each be closed by a cap. After assembly of the fuel metering device, the caps, which are likewise preferably produced from plastic, are joined in sealing fashion to the housing, preferably laser-welded. Thus the housing with the caps is a completely sealed unit. This prevents fuel, which in the form of leaks can occur basically everywhere in the interior of the fuel metering device, from escaping to the outside. Moreover, the housing effects advantageous damping with regard to vibration.

It is also advantageous that an armature bolt of the actuating device is guided axially by at least one bearing, preferably at least one bearing bush. The axial guidance can be improved further by providing that two bearing bushes are spaced relatively widely apart from one another in the interior of the fuel metering device. As a result, tilting of the armature can be averted, and radially acting force components, exerted on the armature by the actuating device in particular (for instance by an electromagnet), can be intercepted. Both the armature bolt and the bearing bushes can be made from metal or plastic, and the armature bolt and the bearing bushes can also be made from different materials.

It is especially advantageous if the valve piston is axially guided in a separate metal sheath. The metal sheath can ensure adequately good mobility of the valve piston, with low frictional forces. Alternatively, the valve piston can also be guided axially in a guide of the housing. Since the plastic material of the housing can be made quite smooth, once again good mobility of the valve piston is ensured. This embodiment is furthermore especially lightweight.

It is also advantageous that a magnetic transition to an armature of the actuating device is effected in an inner region of a magnet coil of the actuating device. Thus only the armature support has to be mounted outside the magnet coil. The structural height of the fuel metering device can advantageously be minimized as a result.

It is moreover possible for a plug receptacle for making electrical contact to be provided on the housing, with the plug receptacle embodied as a separate component, preferably of plastic, and for the plug receptacle to be joined in sealing fashion, preferably laser-welded, to the housing. Thus for making electrical contact, it is possible for the plug receptacle to be an integral component of the plastic housing, or for the plug receptacle to be a separate component. Thus in a standard housing, different plug receptacles (in accordance with different standards) can be used for the fuel metering device.

BRIEF DESCRIPTION OF THE DRAWINGS

Exemplary embodiments of the invention are described as examples in conjunction with the drawings. In the drawings.

DESCRIPTION OF THE PREFERRED EMBODIMENTS

Figure 1:
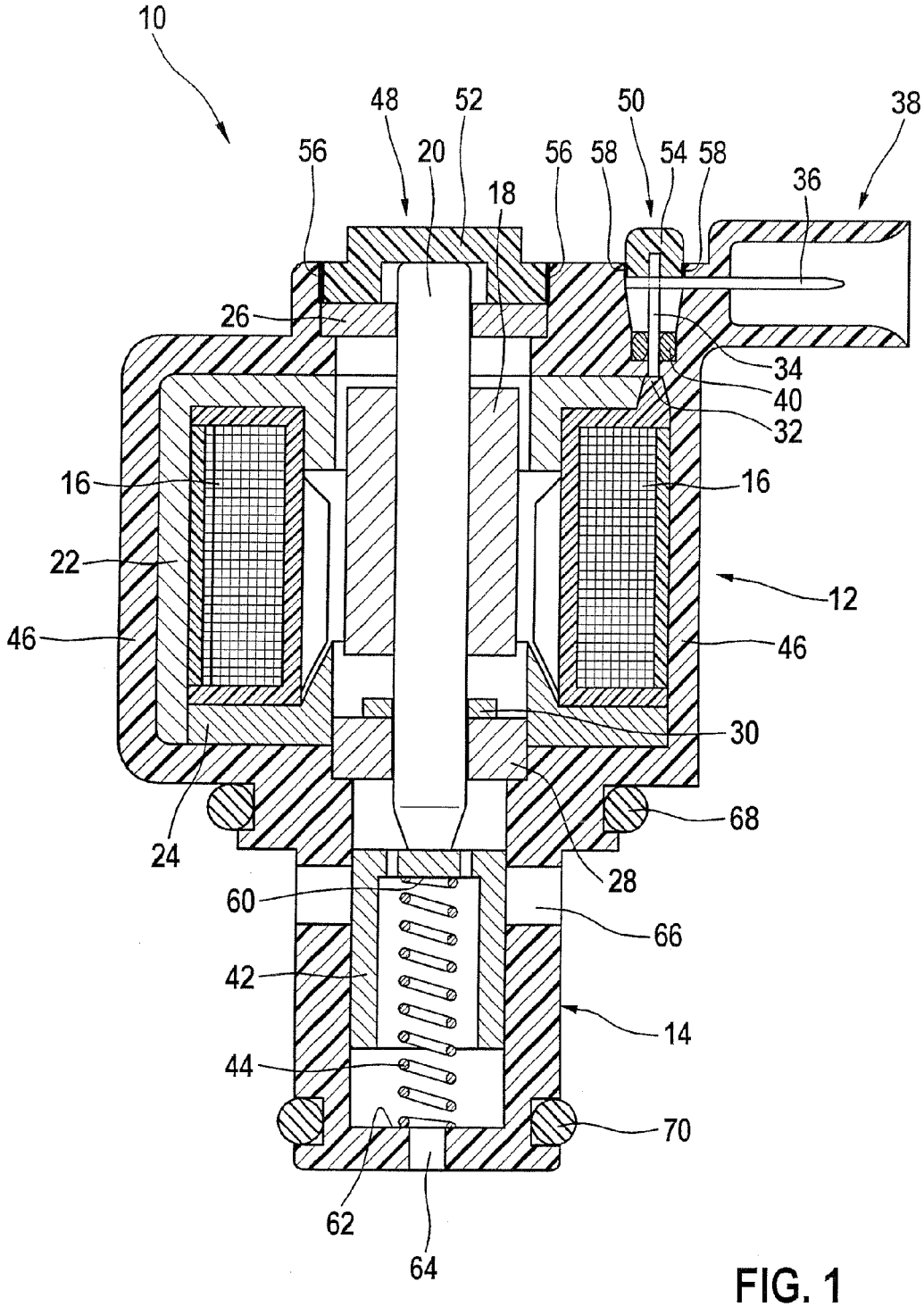
FIG. 1 is a schematic view of a first embodiment of a fuel metering device of the invention in vertical section.

FIG. 1 shows a first embodiment of a metering device 10 of the invention in vertical section. The metering device 10 is preferably disposed in a high-pressure fuel pump for operating an internal combustion engine (not shown).

The metering device 10 includes an actuating device 12 and an integrated control valve 14. In detail, the actuating device 12 essentially comprises a magnet coil 16, an armature 18 with an armature bolt 20, and a magnet cup 22 that partly encloses the magnet coil 16 and the armature 18. The armature bolt 20 may be made from metal or plastic. The magnet cup 22 acts as a magnetic return path.

In FIG. 1, a magnet cone 24 is disposed below the magnet coil 16. The armature bolt 20 is axially guided by a first bearing bush 26 and a second bearing bush 28, and the respective bearing bushes 26 and 28 are disposed in the vicinity of the two ends of the armature bolt 20. The bearing bushes 26 and 28 can be made from metal or plastic. In FIG. 1, a remanent air gap disk 30 is disposed above the second bearing bush 28.

In FIG. 1, the magnet coil 16, on the right-hand side in its upper region, has an electrical contact-making point 32 which is adjoined by a first contact pin 34, which carries the electrical contact via a second contact pin 36 into a plug receptacle 38. The breakthrough point of the first contact pin 34 to the interior of the metering device 10 is sealed off by an O-ring 40, both to protect the contact pin 34 from a short circuit and to protect the entire plug receptacle 38 from corrosive fuel.

The control valve 14 has a displaceable sheathlike valve piston 42, which rests on the armature bolt 20 and is actuated by the armature bolt 20. In the interior of the sheathlike valve piston 42, there is a compression spring 44, which counteracts the force of the actuating device 12 that moves the armature bolt 20.

The entire metering device 10 (actuating device 12 and control valve 14) is enclosed by a plastic housing 46. The plastic housing 46 fixes the magnet coil 16, the first and second bearing bushes 26 and 28, the electrical contact pins 34 and 36, to the plug receptacle 38 and acts as a guide for the movable valve piston 42. The plastic housing 46 may be an individual housing, which can be produced by spray-coating; or it can be a standard housing (universal housing). For introducing the components into the interior of the metering device 10, the plastic housing 46 has a first assembly opening 48. For inserting the electrical contact pin 34 and its connection with the second contact pin 36, the plastic housing 46 has a second assembly opening 50. The assembly openings 48 and 50 are closed with lidlike cover caps 52 and 54 and are laser-welded (see references numerals 56 and 58) to the plastic housing 46. Thus the plastic housing 46, with the cover caps 52 and 54, is a fully sealed unit.

The compression spring 44 is braced at the front on a base 60 of the valve piston 42 and at the back on a part of the plastic housing 46 that is embodied as a spring plate 62. The spring plate 62 has a central inlet opening 64, which connects the interior of the valve piston 42 to a prefeed pump (not shown) of a fuel injection system of an internal combustion engine. Also in a lateral region in what in FIG. 1 is the upper region of the valve piston 42, the plastic housing 46 has a radially oriented outlet opening 66, as an operative hydraulic communication, to the high-pressure fuel pump, not shown.

In the region of the outlet opening 66, radial through openings (not shown) are disposed in the wall of the valve piston 42, to allow the fuel flowing in through the inlet opening 64 to flow out again. The through opening can be a laser-cut slot of virtually arbitrary shape, or it may be embodied as a bore. In FIG. 1, an axially sealing O-ring 68 is disposed above the outlet opening 66, and a radially sealing O-ring 70 is disposed in the region of the inlet opening 64.

The flow-through principle in the metering device 10 can also be reversed (not shown). Then the opening 64 would communicate hydraulically with the high-pressure fuel pump, while the opening 66 would communicate with the compression side of the prefeed pump and would thus form the inlet into the metering device 10.

The metering device 10 functions essentially as follows: The magnetic force of the magnet coil 16 to which current is supplied acts via the armature bolt 20 on the valve piston 42 and moves the latter, counter to the resistance of the compression spring 44, continuously into a closing position of the control valve 14. Conversely, the compression spring 44 is capable of displacing the valve piston 42 continuously into the opening position, if the current supply to the magnet coil 16 and thus the magnetic force acting on the armature 18 and the armature bolt 20 are reduced accordingly. In the process, the flow cross section of the through opening, not shown, in the wall of the valve piston 42 is changed, and thus the flow quantity of fuel is varied. By both the design of the through opening and the local position of the valve piston 42, a hydraulic characteristic curve of the metering device 10 can be varied.

Figure 2:
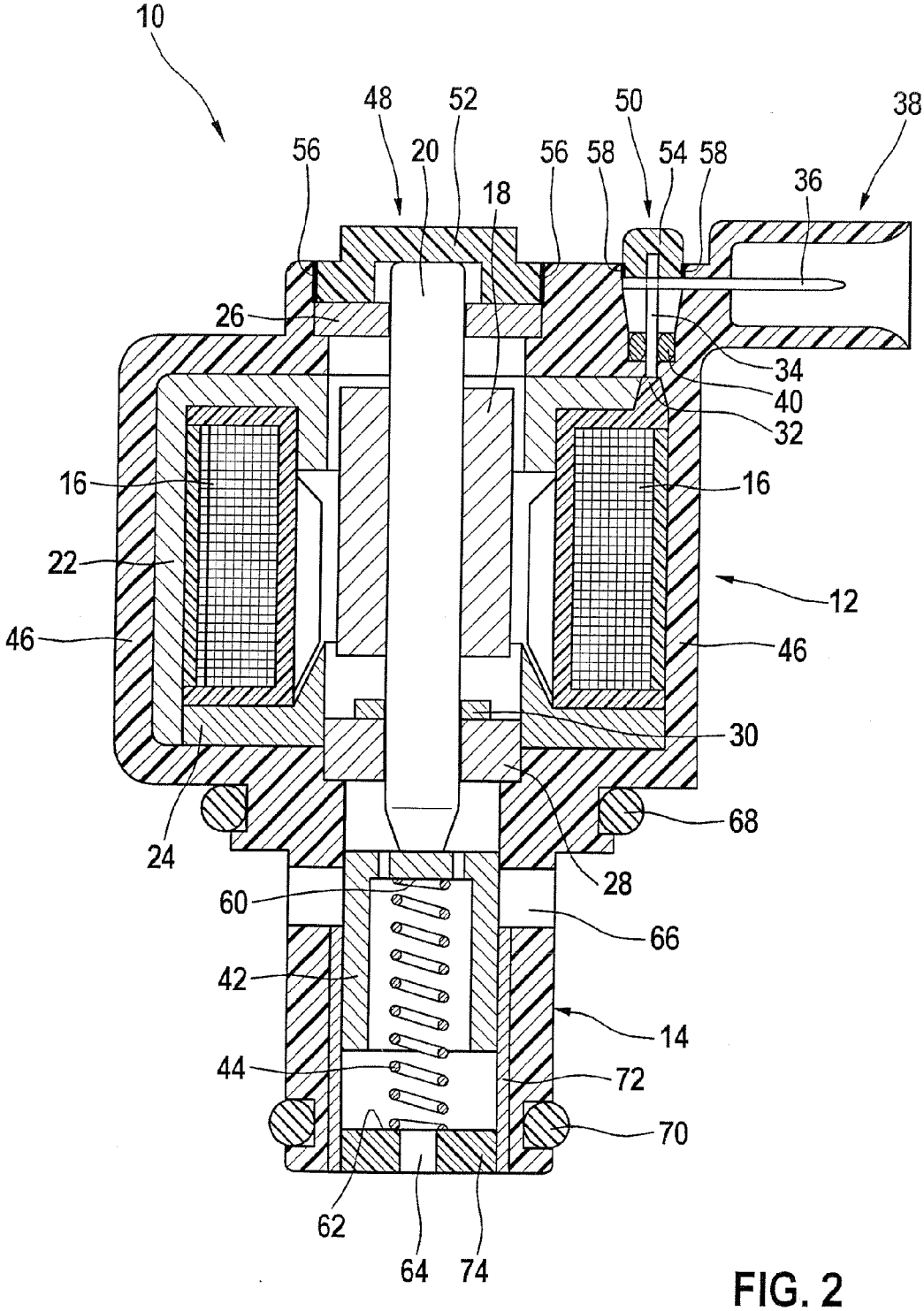
FIG. 2 is a schematic view of a second embodiment of the fuel metering device of the invention in vertical section.

FIG. 2 shows a second embodiment of the metering device 10 in vertical section. For it and the drawing that follows, those elements and regions that are functionally equivalent to elements and regions of the metering device of FIG. 1 have the same reference numerals and are not described again in detail. In the second embodiment of the metering device 10, the valve piston 42 is guided in a metal sheath 72. Moreover, the metering device 10 has an axially displaceable adjusting element 74, which on the one hand acts as a spring plate 62, and on the other to enable it to perform suitable prestressing after installation. After the compression spring 44 has been installed, the adjusting element 74 is fixed so that it cannot be detached.

Figure 3:
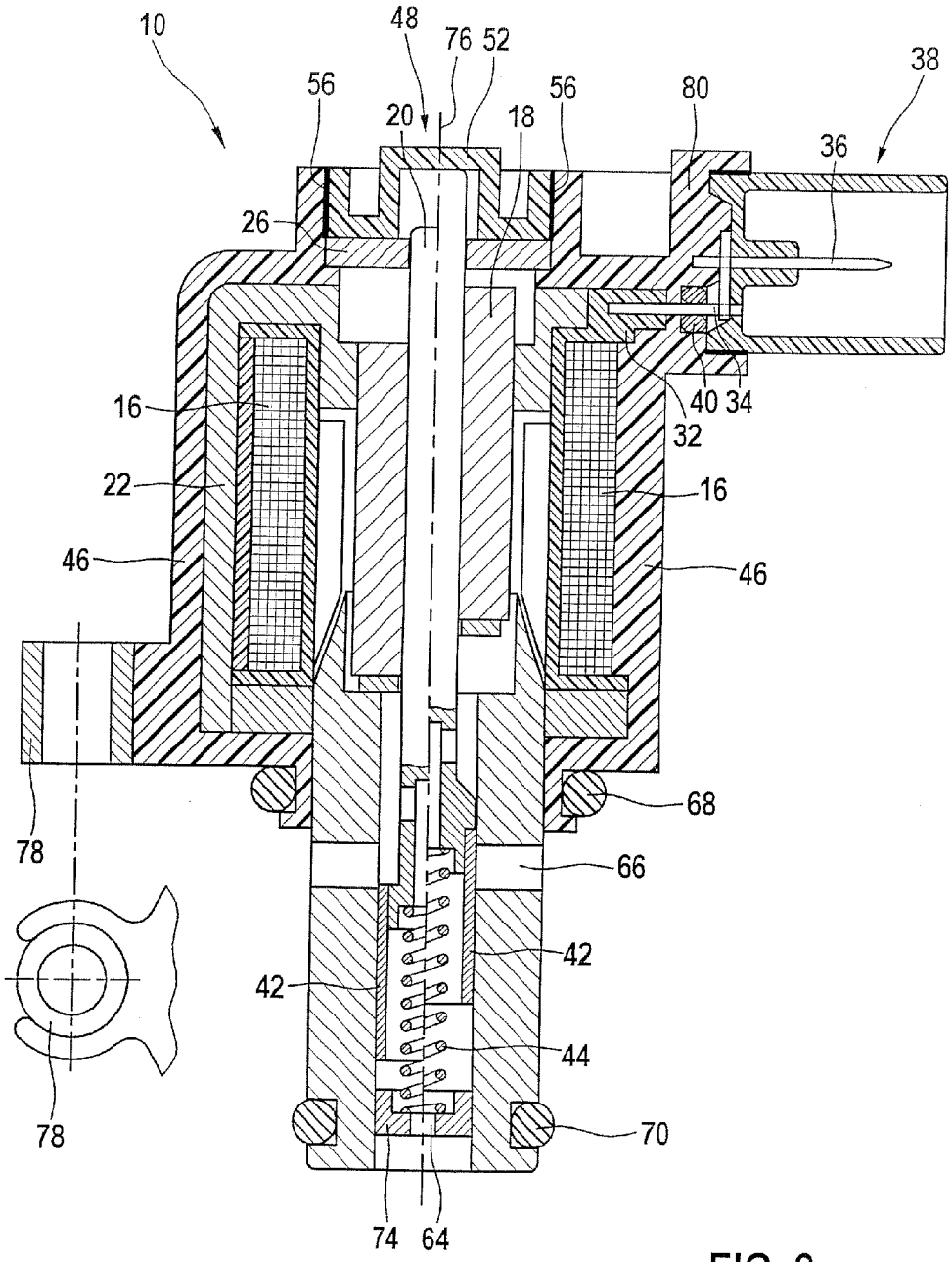
FIG. 3 is a schematic view of a third embodiment of the fuel metering device of the invention in vertical section.

FIG. 3 shows a third embodiment of the metering device 10 in vertical section. To the left of a center line 76, the view shows the metering device 10 in the opened position, and to the right of the center line 76 it shows the metering device 10 in the closed position. In this embodiment, the metering device 10 is installed in a plastic universal housing. The universal housing has a spacer sleeve 78, for securing the metering device 10 in the high-pressure fuel pump, for instance by means of a screw connection. Initially, the universal housing has no plug receptacle but only a profile section 80, for the insertion of a standardized plug receptacle 38 in the form of a separate component, and as one possible way of inserting at least the first electrical contact 34. Hence the metering device 10 can be adapted to various plug systems. The plug receptacle 38 is laser-welded to the plastic housing 46, and the profile section 80 is part of the plastic housing 46.

The foregoing relates to the preferred exemplary embodiments of the invention, it being understood that other variants and embodiments thereof are possible within the spirit and scope of the invention, the latter being defined by the appended claims.

The invention claimed is:

1. A fuel metering device for a system for injecting fuel into an internal combustion engine, having a housing, the fuel metering device having a control valve which has a valve piston that is actuated by an actuating device, wherein the housing comprises a spray-coating of plastic:

wherein the housing has at least one opening for introducing components of the fuel metering device, and each at least one opening is closable by a respective cap.

2. The fuel metering device as defined by claim 1, wherein the housing has a sealing function outward with regard to the fuel.

3. The fuel metering device as defined by claim 2, wherein an armature bolt of the actuating device is guided axially by at least one bearing, embodied as a bearing bush.

4. The fuel metering device as defined by claim 1, wherein the cap is joined in sealing fashion to the housing.

5. The fuel metering device as defined by claim 4, wherein an armature bolt of the actuating device is guided axially by at least one bearing, embodied as a bearing bush.

6. The fuel metering device as defined by claim 5, wherein the valve piston is guided axially in a separate metal sheath.

7. The fuel metering device as defined by claim 5, wherein the valve piston is guided axially in a guide of the housing.

8. The fuel metering device as defined by claim 7, wherein a magnetic transition to an armature of the actuating device is effected in an inner region of a magnet coil of the actuating device.

9. The fuel metering device as defined by claim 8, wherein a plug receptacle for making electrical contact is provided on the housing.

10. The fuel metering device as defined by claim 1, wherein an armature bolt of the actuating device is guided axially by at least one bearing, embodied as a bearing bush.

11. The fuel metering device as defined by claim 1, wherein the valve piston is guided axially in a separate metal sheath.

12. The fuel metering device as defined by claim 1, wherein the valve piston is guided axially in a guide of the housing.

13. The fuel metering device as defined by claim 1, wherein a magnetic transition to an armature of the actuating device is effected in an inner region of a magnet coil of the actuating device.

14. The fuel metering device as defined by claim 1, wherein a plug receptacle for making electrical contact is provided on the housing.

15. The fuel metering device as defined by claim 1, wherein the plug receptacle is embodied as a separate component and the plug receptacle is joined in sealing fashion to the housing.

16. The fuel metering device as defined by claim 1, wherein the respective cap is configured to close off the at least one opening in a sealable fashion such that the housing and the respective cap together form a completely sealed unit configured to prevent fuel within the fuel metering device from leaking out of the fuel metering device.

17. The fuel metering device as defined by claim 16, wherein the sealable fashion includes a laser weld between the respective cap and the housing.

18. The fuel metering device as defined by claim 16, further comprising a plug receptacle for making electrical contact, wherein the plug receptacle is joined to the housing in a sealable fashion.

* * * * *